US008617698B2

(12) United States Patent
Sansom

(10) Patent No.: US 8,617,698 B2
(45) Date of Patent: Dec. 31, 2013

(54) DAMAGE RESISTANT THERMAL BARRIER COATING AND METHOD

(75) Inventor: David G. Sansom, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 365 days.

(21) Appl. No.: 13/094,997

(22) Filed: Apr. 27, 2011

(65) Prior Publication Data

US 2012/0276355 A1 Nov. 1, 2012

(51) Int. Cl.

| | |
|---|---|
| ***B32B 7/02*** | (2006.01) |
| ***B32B 3/26*** | (2006.01) |
| ***B05D 5/00*** | (2006.01) |

(52) U.S. Cl.
USPC ..... 428/218; 428/319.1

(58) Field of Classification Search
USPC ..... 428/218, 319.1
See application file for complete search history.

(56) References Cited

U.S. PATENT DOCUMENTS

| | | | | |
|---|---|---|---|---|
| 5,049,450 | A | 9/1991 | Dorfman et al. | |
| 5,073,433 | A | 12/1991 | Taylor | |
| 5,770,126 | A | 6/1998 | Singh et al. | |
| 5,830,586 | A * | 11/1998 | Gray et al. | 428/621 |
| 5,976,695 | A | 11/1999 | Hajmrle et al. | |
| 6,180,184 | B1 * | 1/2001 | Gray et al. | 427/453 |
| 6,294,260 | B1 | 9/2001 | Subramanian | |
| 6,306,517 | B1 * | 10/2001 | Gray et al. | 428/469 |
| 6,432,487 | B1 | 8/2002 | Graham et al. | |
| 6,482,476 | B1 | 11/2002 | Liu | |
| 6,491,967 | B1 | 12/2002 | Corderman et al. | |
| 6,703,137 | B2 | 3/2004 | Subramanian | |
| 6,716,539 | B2 | 4/2004 | Subramanian | |
| 6,780,458 | B2 | 8/2004 | Seth et al. | |
| 6,887,530 | B2 | 5/2005 | Fiala et al. | |
| 6,939,603 | B2 | 9/2005 | Oechsner | |
| 7,112,758 | B2 | 9/2006 | Ma et al. | |
| 7,128,962 | B2 | 10/2006 | Braillard et al. | |
| 7,135,240 | B2 | 11/2006 | Fiala et al. | |
| 7,179,507 | B2 | 2/2007 | Fiala et al. | |
| 7,291,403 | B2 | 11/2007 | Nagaraj et al. | |
| 7,294,413 | B2 | 11/2007 | Nagaraj et al. | |
| 7,402,347 | B2 | 7/2008 | Morrison et al. | |
| 7,556,851 | B2 | 7/2009 | Lampenscherf | |
| 7,597,966 | B2 | 10/2009 | Spitsberg et al. | |
| 7,648,605 | B2 | 1/2010 | Merrill et al. | |
| 2004/0081760 | A1 | 4/2004 | Burns et al. | |
| 2005/0276686 | A1 | 12/2005 | Bruce | |
| 2007/0122639 | A1 | 5/2007 | Fiala et al. | |
| 2008/0145629 | A1 | 6/2008 | Anoshkina et al. | |
| 2008/0160172 | A1 * | 7/2008 | Taylor et al. | 427/9 |

(Continued)

OTHER PUBLICATIONS

Anand Kulkarni , A. Vaidya, A. Goland, S. Sampath, H. Herman; Processing effects on porosity-property correlations in plasma sprayed yttria-stabilized zirconia coatings; Apr. 4, 2003; Materials and Engineering A359 (2003); pp. 100-111.*

*Primary Examiner* — David Sample
*Assistant Examiner* — Tahseen N Khan

(57) ABSTRACT

A compliant, impact-absorbing layer (27) on a thermal barrier coating (TBC) (26) on a substrate (24). The impact-absorbing layer (27) has an internal structure of planar grains (28) oriented parallel to the substrate so the impact-absorbing layer preferentially fractures horizontally and it blocks vertical cracking. A ceramic armor layer (30) on the impact-absorbing layer has a higher density, and is fractured (32) into fracture plates (33, 34) of a designed size. This provides a thermal barrier with particle impact-resistance that may be applied to gas turbine components where needed.

9 Claims, 2 Drawing Sheets

(56) References Cited

U.S. PATENT DOCUMENTS

| | | | | |
|---|---|---|---|---|
| 2008/0213617 | A1* | 9/2008 | Taylor et al. | 428/603 |
| 2008/0220209 | A1* | 9/2008 | Taylor et al. | 428/134 |
| 2009/0258247 | A1 | 10/2009 | Kulkarni et al. | |
| 2010/0015350 | A1 | 1/2010 | Allen | |
| 2010/0081558 | A1* | 4/2010 | Taylor | 501/135 |
| 2011/0171488 | A1* | 7/2011 | Taylor | 428/623 |
| 2012/0003102 | A1* | 1/2012 | Taylor et al. | 416/241 R |
| 2012/0122651 | A1* | 5/2012 | Taylor et al. | 501/104 |

* cited by examiner

FIG 1
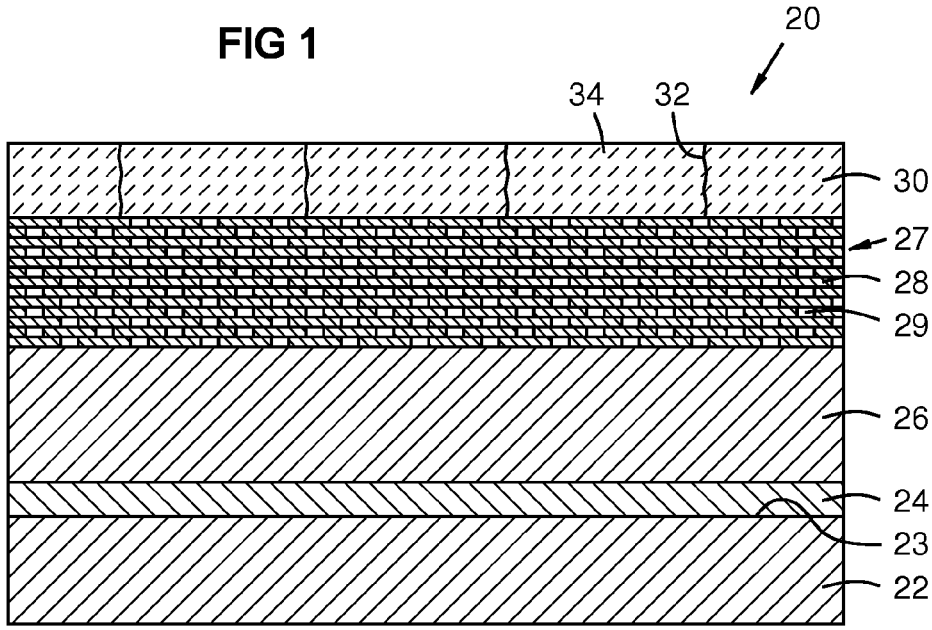
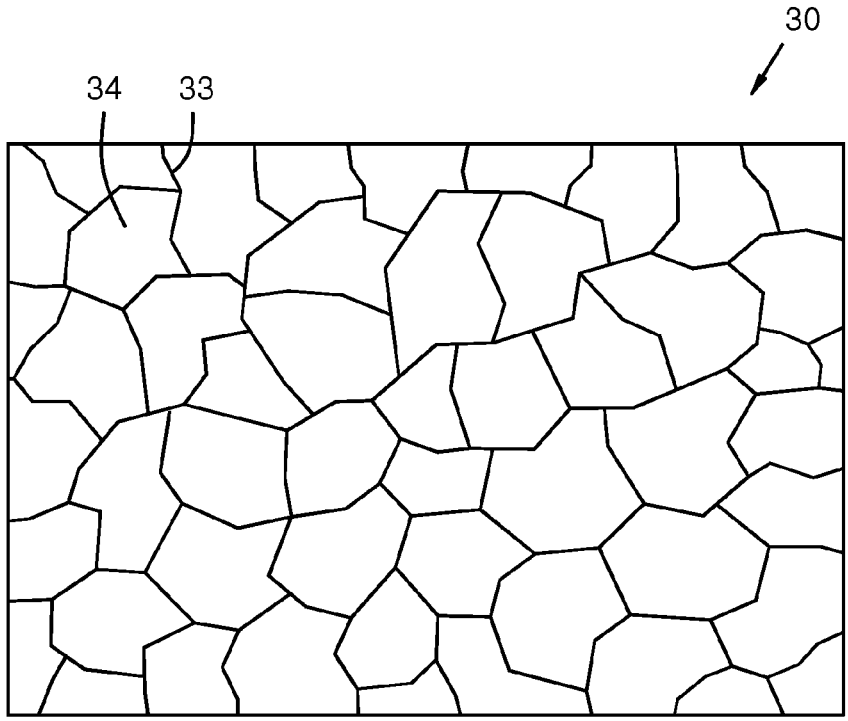
FIG 2

DAMAGE RESISTANT THERMAL BARRIER COATING AND METHOD

FIELD OF THE INVENTION

The invention relates to particle impact resistant thermal barrier coatings, particularly on internal turbine components.

BACKGROUND OF THE INVENTION

Some components of gas turbine engines, such as vanes and blades, operate at temperatures up to about 1500° C. Ceramic thermal barrier coatings (TBCs) are used to insulate such components from heat, reduce surface oxidation, and reduce wear and damage caused by ingestion of foreign objects from the external air intake or from debris within the engine. Impacts from foreign objects and debris can spall the TBC, reducing its life. Hard particles commonly ranging from about 5 to 100 microns in diameter erode surfaces bounding the working gas flow path. The present coating and method reduces and controls such damage.

BRIEF DESCRIPTION OF THE DRAWINGS

The invention is explained in the following description in view of the drawings that show:

FIG. 1 is a conceptual sectional view of a multi-layer thermal barrier coating on a component substrate per aspects of the invention.

FIG. 2 is a top view of the top layer of FIG. 1.

DETAILED DESCRIPTION OF THE INVENTION

Figure 3:
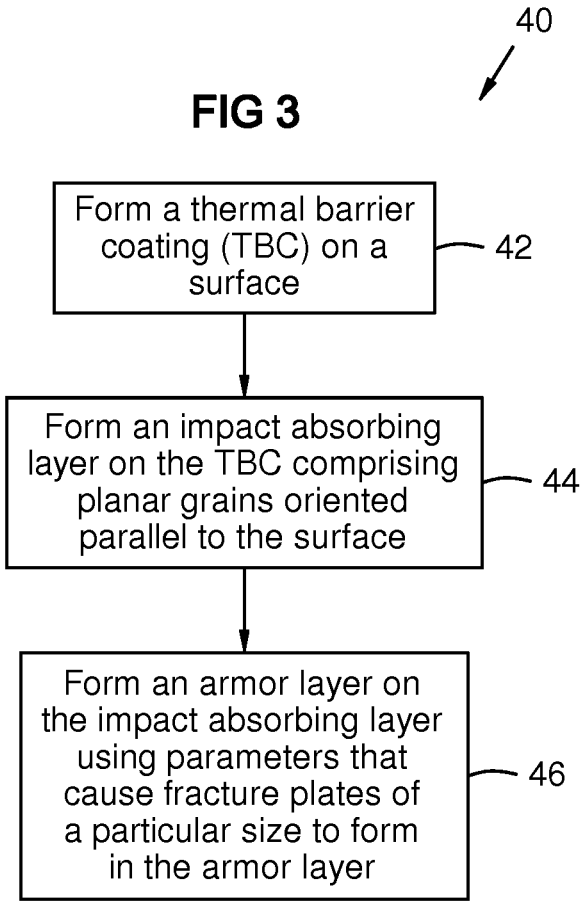
FIG. 3 illustrates a method according to aspects of the invention.

FIG. 1 is a sectional view of a component substrate 22 having a surface 23 with a bond coat 24 and a thermal barrier coating (TBC) 26. The substrate may be made of a high-temperature structural material such as a nickel-based superalloy or a ceramic matrix composite. The bond coat 24 may be any type suitable for the materials of the substrate and the TBC as known in the art. For example, the bond coat 24 may be an MCrAlY alloy, where M is selected from the group of Ni, Co, Fe and their mixtures, and Y can include yttrium Y, as well as La and Hf. The bond coat may be applied for example by sputtering, electron beam vapor deposition, or low pressure plasma spraying, to provide a dense, relatively uniform layer such as about 0.02 mm to 0.25 mm thick.

The TBC 26 may comprise yttria-stabilized zirconia (YSZ) or a gadolinium zirconate (GZO) such as $Gd_2$ $Zr_2O_7$ and/or other TBC materials known in the art. The TBC layer 26 may cover the exterior surface 23 of a turbine component in the working gas flow. Two additional protective layers 27 and 30 may cover some or all of the TBC 26 for particle impact protection.

Impact-absorbing layer 27 is a relatively soft anisotropic layer that absorbs the energy of particle impacts and stops vertical crack propagation. Layer 27 may be applied by a thermal spray process, such as plasma spray, that produces overlapping pancake-like lamellae 28 called "splats" with respective diameters oriented parallel to the substrate surface 23, forming a porous, compliant, planar-grained layer. The overlapping splats 28 block vertical crack propagation. "Vertical" means normal to the substrate surface 23. Layer 27 may have less than 75% of theoretical density, due to voids 29. A desired density can be achieved by setting thermal spray parameters such as feedstock, plasma gas composition and flow rate, energy input, torch offset distance, and substrate cooling, as known in the art.

Armor layer 30 is a relatively hard layer designed to crack along vertical fractures 32 into a geometry of fracture plates 34 (FIG. 2) with perimeters 33. These plates limit impact damage horizontally to a diameter or zone, because any impact-induced horizontal cracks will stop at a vertical crack 32, 33. The plates 34 may have an average diameter larger than the average diameter of splats 28 in the impact-absorbing layer 27 to spread the load of the impact and allow a larger volume of the underlying layer 27 to be used to absorb the impact energy. The plates 34 form an impact-absorbing armor in conjunction with the impact-absorbing layer 27. The fracture plates 34 may be made small enough to recoil from the particle impacts to absorb energy, yet large enough to spread the energy over a larger area than either the impact particle size or the absorbing layer grain size. For example, the fracture plates 34 may range in size from 0.25 to 2.0 mm and especially from 0.5 to 1.5 mm. A desired size range can be achieved for a given thickness of the armor layer by setting thermal spray parameters as known in the art. Alternately, a honeycomb pattern of score lines may be laser-engraved on the armor layer to promote vertical cracks in a geometry of fracture plates of a predetermined size. The armor layer may have greater than 90% of theoretical density, and especially greater than 95%.

Each protective layer 27, 30 has a specialized role. These two layers work synergistically to limit damage both horizontally and vertically, and to absorb impact energy, thus protecting the TBC 26. To reduce cost and weight, the protective layers 27, 30 may be limited to areas where damaging particle impacts occur, such as the leading edges of blades, vanes, and other parts.

All layers 24, 26, 27, and 30 may be applied by a thermal spray process such as plasma spray or high velocity oxygen fuel spray. The protective layers 27 and 30 may use the same materials as layer 26, but with different spray parameters. Alternately, different materials may be used for different layers. The thickness of layer 30 may be engineered in conjunction with its hardness such that process shrinkage of layer 30 produces fracture plates 34 of the desired sizes.

FIG. 3 illustrates a method 40 per aspects of the invention, including the steps of: 42—Form a thermal barrier coating (TBC) on a surface; 44—Form an impact-absorbing layer on the TBC including planar grains oriented parallel to the surface; 46—Form an armor layer on the impact-absorbing layer with fracture plates of a design size range.

The impact-absorbing layer 27 may have 10-35% greater porosity than the armor layer 30, and especially 15-35% more porosity. For example, the TBC 26 may be formed of 7-9 mol % YSZ with 9-15% porosity, the impact-absorbing layer 27 may be formed of 7-9 mol % YSZ with 25-35% porosity, and the armor layer 30 may be formed of 7-9 mol % YSZ with 2-10% porosity.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A damage resistant thermal barrier coating, comprising:

a thermal barrier layer (TBC) on a component substrate;

an impact-absorbing layer on the thermal barrier layer, wherein the impact-absorbing layer comprises an anisotropic internal structure that stops fractures normal to the substrate and preferentially fractures parallel to the substrate; and an armor layer on the impact-absorbing layer, wherein the armor layer has a density that is higher than a density of the impact-absorbing layer, and the armor layer comprises fractures normal to the substrate forming a pattern of fracture plates in a design size range.

2. The damage resistant thermal barrier coating of claim 1, wherein the impact-absorbing layer density is less than 75% of theoretical density, and the armor layer density is greater than 95% of theoretical density.

3. The damage resistant thermal barrier coating of claim 1, wherein the fracture plates have an average diameter selected from within a range of 0.25 to 2.0 mm.

4. The damage resistant thermal barrier coating of claim 1, wherein the fracture plates have an average diameter selected from within a range of 0.5 to 1.5 mm.

5. The damage resistant thermal barrier coating of claim 1, wherein the TBC comprises 7-9 mol % YSZ with 9-15% porosity, the impact-absorbing layer comprises 7-9 mol % YSZ with 25-35% porosity, and the armor layer comprises 7-9 mol % YSZ with 2-10% porosity.

6. The damage resistant thermal barrier coating of claim 1, wherein the impact-absorbing layer comprises a porous, compliant layer of planar grains oriented parallel to the substrate.

7. The damage resistant thermal barrier coating of claim 6, wherein the impact-absorbing layer has 15-35% greater porosity than the armor layer.

8. The damage resistant thermal barrier coating of claim 7, wherein the thermal barrier layer, the impact-absorbing layer, and the armor layer each comprise yttria-stabilized zirconia or gadolinium zirconate.

9. A damage resistant thermal barrier coating, comprising:

a ceramic thermal barrier layer on a component substrate;

a porous, compliant, impact-absorbing ceramic layer on the thermal barrier layer, wherein the impact-absorbing ceramic layer comprises an internal structure of planar grains oriented parallel to the substrate, and has less than 75% of theoretical density; and a ceramic armor layer on the impact-absorbing layer, wherein the ceramic armor layer has greater than 95% of theoretical density and is fractured into fracture plates with an average diameter of 0.5 to 1.5 mm.

* * * * *